US007935198B2

(12) United States Patent
Branagan et al.

(10) Patent No.: US 7,935,198 B2
(45) Date of Patent: May 3, 2011

(54) GLASS STABILITY, GLASS FORMING ABILITY, AND MICROSTRUCTURAL REFINEMENT

(75) Inventors: Daniel James Branagan, Idaho Falls, ID (US); M. Craig Marshall, Iona, ID (US); Brian Meacham, Idaho Falls, ID (US)

(73) Assignee: The NanoSteel Company, Inc., Providence, RI (US)

( * ) Notice: Subject to any disclaimer, the term of this patent is extended or adjusted under 35 U.S.C. 154(b) by 0 days.

(21) Appl. No.: 11/843,138

(22) Filed: Aug. 22, 2007

(65) Prior Publication Data

US 2008/0053274 A1 Mar. 6, 2008

Related U.S. Application Data

(63) Continuation-in-part of application No. 11/458,209, filed on Jul. 18, 2006, which is a continuation-in-part of application No. 11/057,400, filed on Feb. 11, 2005, now Pat. No. 7,553,382.

(51) Int. Cl.
*C22C 38/26* (2006.01)
*C22C 38/32* (2006.01)

(52) U.S. Cl. ..... 148/328; 148/326; 148/330

(58) Field of Classification Search ..... 148/304, 148/305, 403, 320, 326, 328, 330; 219/146.1; 420/64, 70, 127, 129; 75/254
See application file for complete search history.

(56) References Cited

U.S. PATENT DOCUMENTS

| | | | | |
|---|---|---|---|---|
| 4,297,135 | A * | 10/1981 | Giessen et al. | 148/321 |
| 4,365,994 | A * | 12/1982 | Ray | 148/325 |
| 4,495,691 | A * | 1/1985 | Masumoto et al. | 29/527.5 |
| 4,842,657 | A * | 6/1989 | Masumoto et al. | 148/403 |
| 5,966,064 | A * | 10/1999 | Yoshizawa et al. | 336/221 |
| 6,258,185 | B1 | 7/2001 | Branagan et al. | |
| 6,350,323 | B1 | 2/2002 | Inoue et al. | |
| 6,689,234 | B2 | 2/2004 | Branagan et al. | |
| 2003/0051781 | A1 * | 3/2003 | Branagan | 148/561 |
| 2004/0250929 | A1 | 12/2004 | Branagan et al. | |
| 2006/0180252 | A1 | 8/2006 | Branagan et al. | |
| 2007/0029295 | A1 | 2/2007 | Branagan et al. | |

FOREIGN PATENT DOCUMENTS

| | | |
|---|---|---|
| DE | 3120168 | 2/1982 |
| EP | 0072893 | 3/1983 |
| EP | 1482064 | 12/2004 |
| JP | 55104450 | 8/1980 |
| JP | 58055557 | 4/1983 |
| JP | 59013056 | 1/1984 |

(Continued)

OTHER PUBLICATIONS

D.J. Branagan and Y. Tang, Developing extreme hardness (> 15 GPa) in iron-based nanocomposites, Composites: Part A:, vol. 33, (2002), p. 855-859.*

(Continued)

*Primary Examiner* — George Wyszomierski
*Assistant Examiner* — Mark L Shevin
(74) *Attorney, Agent, or Firm* — Grossman, Tucker, Perreault & Pfleger, PLLC

(57) ABSTRACT

The present invention relates to the addition of niobium to iron based glass forming alloys. More particularly, the present invention is related to changing the nature of crystallization resulting in glass formation that may remain stable at much higher temperatures, increasing the glass forming ability and increasing devitrified hardness of the nanocomposite structure.

3 Claims, 9 Drawing Sheets

FOREIGN PATENT DOCUMENTS

| | | |
|---|---|---|
| JP | 61157661 | 7/1986 |
| JP | 01025943 | 1/1989 |
| WO | 0229832 | 4/2002 |
| WO | 03069000 | 8/2003 |

OTHER PUBLICATIONS

K. Kishitake et al. Characterization of Plasma Sprayed Fe-10Cr-10Mo-(C,B) Amorphous Coatings. Journal of Thermal Spray Technology, vol. 5, No. 2, Jun. 1996, p. 145-153.*

International Search Report and Written Opinion dated Jan. 28, 2008 issued in International Patent Application No. PCT/US0773757.

International Search Report and Written Opinion dated Feb. 14, 2008 issued in International Patent Application No. PCT/US0604198.

Pekala et al., "Transport and Magnetic Properties of HITPERM alloys," IOP Publishing, Nanotechnology 14 (2003) pp. 196-199.

U.S. Office Action dated May 27, 2008 issued in related U.S. Appl. No. 11/057,400.

U.S. Office Action dated Sep. 6, 2007 issued in related U.S. Appl. No. 11/057,400.

Ma, et al., "Effect of Nb addition glass-forming ability, strength and hardness of Fe-B-Zr amorphous alloys," Materials Research Bulletin vol. 34 No. 6 (1999) pp. 915-920.

Kulik, "Nanocrystallization of Matalic Glasses," Journal of Non-Crystaline Solids 287 (2001), pp. 145-161.

Inoue, et al., "New Fe-based bulk glassy alloys with high saturated magnetic flux density of 1.4-1.5T," Materials Science and Engineering A 375-377 (2004), pp. 302-306.

Marin, et al., "Influence of Cu and Nb on Relaxation and Crystallization of Amorphous FesiB(CuNb) Wires," Nanostructured Materials, vol. 10 No. 2 (1998) pp. 299-310.

International Preliminary Report on Patentability dated Jan. 29, 2009 issued in related International Patent Application No. PCT/US2007/073757.

European Search Report dated Jan. 18, 2010 issued in related European Patent Application No. 06734457.

Chinese Office Action dated Mar. 12, 2010 issued in related Chinese Patent Application No. 20068008186.9.

* cited by examiner

GLASS STABILITY, GLASS FORMING ABILITY, AND MICROSTRUCTURAL REFINEMENT

CROSS-REFERENCE TO RELATED APPLICATIONS

The present application is a continuation-in-part of U.S. patent application Ser. No. 11/458,209, filed Jul. 18, 2006, which is a continuation-in-part of U.S. patent application Ser. No. 11/057,400 filed Feb. 11, 2005, now U.S. Pat. No. 7,553,382, incorporated herein by reference.

FIELD OF INVENTION

The present invention relates to metallic glasses and more particularly to iron based alloys and iron based glasses and more particularly to the addition of Niobium to these alloys.

BACKGROUND

Conventional steel technology is based on manipulating a solid-state transformation called a eutectoid transformation. In this process, steel alloys are heated into a single phase region (austenite) and then cooled or quenched at various cooling rates to form multiphase structures (i.e. ferrite and cementite). Depending on how the steel is cooled, a wide variety of microstructures (ie. pearlite, bainite and martensite) can be obtained with a wide range of properties.

Another approach to steel technology is called glass devitrification, producing steels with bulk nanoscale microstructures. The supersaturated solid solution precursor material is a super cooled liquid, called a metallic glass. Upon superheating, the metallic glass precursor transforms into multiple solid phases through devitrification. The devitrified steels form specific characteristic nanoscale microstructures, analogous to those formed in conventional steel technology.

It has been known for at least 30 years, since the discovery of metallic glasses, that iron based alloys could be made into metallic glasses. However, with few exceptions, these iron based glassy alloys have had very poor glass forming ability and the amorphous state could only be produced at very high cooling rates ($>10^6$ K/s). Thus, these alloys may be processed by techniques which give very rapid cooling such as drop impact or melt-spinning techniques.

While conventional steels have critical cooling rates for forming metallic glasses in the range of $10^9$ K/s, special iron based metallic glass forming alloys have been developed having a critical cooling rate orders of magnitude lower than conventional steels. Some special alloys have been developed that may produce metallic glasses at cooling rates in the range of $10^4$ to $10^5$ K/s. Furthermore, some bulk glass forming alloys have critical cooling rates in the range of $10^0$ to $10^2$ K/s, however these alloys may employ rare or toxic alloying elements to increase glass forming ability, such as the addition of beryllium, which is highly toxic, or gallium, which is expensive. The development of glass forming alloys which are low cost and environmentally friendly has proven much more difficult.

In addition to the difficulty in developing cost effective and environmentally friendly alloys, the very high cooling rate required to produce metallic glass has limited the manufacturing techniques that are available for producing articles from metallic glass. The limited manufacturing techniques available have in turn limited the products that may be formed from metal glasses, and the applications in which metal glasses may be used. Conventional techniques for processing steels from a molten state may provide cooling rates on the order of $10^{-2}$ to $10^0$ K/s. Special alloys that are more susceptible to forming metallic glasses, i.e., having reduced critical cooling rates on the order of $10^4$ to $10^5$ K/s, may not be processed using conventional techniques with such slow cooling rates and still produce metallic glasses. Even bulk glass forming alloys having critical cooling rates in the range of $10^0$ to $10^2$ K/s, may be limited in the available processing techniques, and have the additional processing disadvantage in that they may not be processed in air but only under very high vacuum.

SUMMARY

An aspect of the present disclosure relates to an iron based alloy. The alloy may include at least 55 atomic % iron, at least one transition metal selected from the group consisting of Ti, Zr, Hf, V, Nb, Ta, Cr, Mo, W, Al, Mn or Ni present in the range of about 7 at % to 20 at %, at least one non/metal or metalloid selected from the group consisting of B, C, N, 0, P, Si, or S present in the range of about 0.01 at % to 25 at %, and niobium present in the range of about 0.01 at % to 10 at %.

BRIEF DESCRIPTION OF DRAWINGS

The detailed description below may be better understood with reference to the accompanying figures which are provided for illustrative purposes and are not to be considered as limiting any aspect of the disclosure herein or claims appended hereto.

FIG. 7*a* is a backscattered electron micrograph image and FIG. 7*b* is a secondary electron micrograph image;

DETAILED DESCRIPTION

Figure 1:
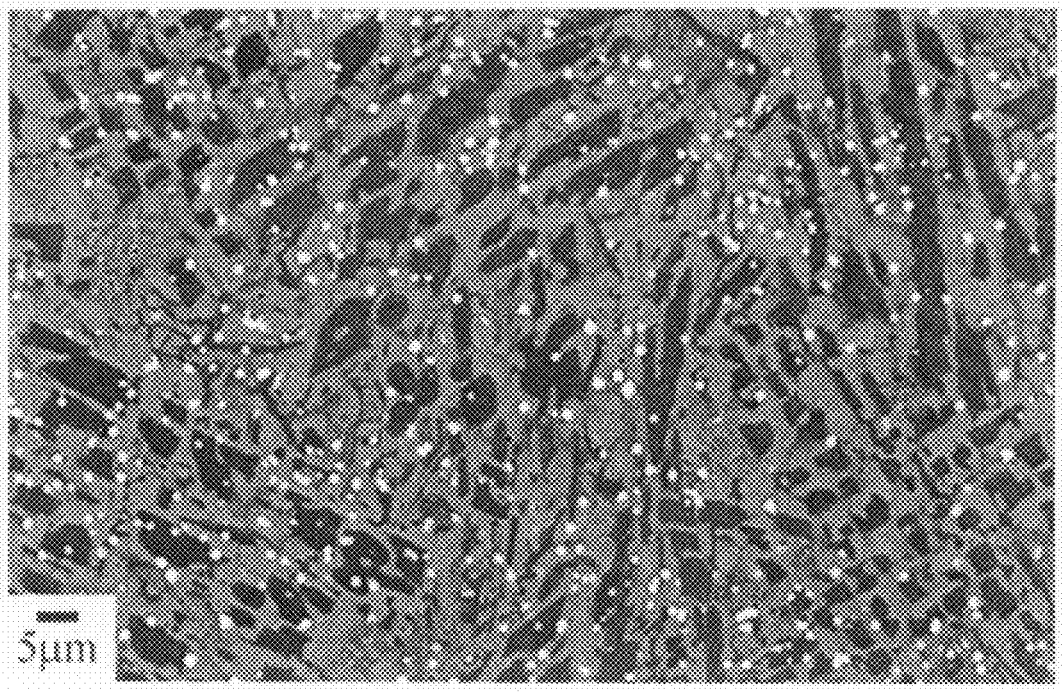
FIG. 1 illustrates a scanning electron image of the microstructure of Alloy LCW1 1/16 inch GMAW weld near the bottom of a single pass weld.
Figure 2:
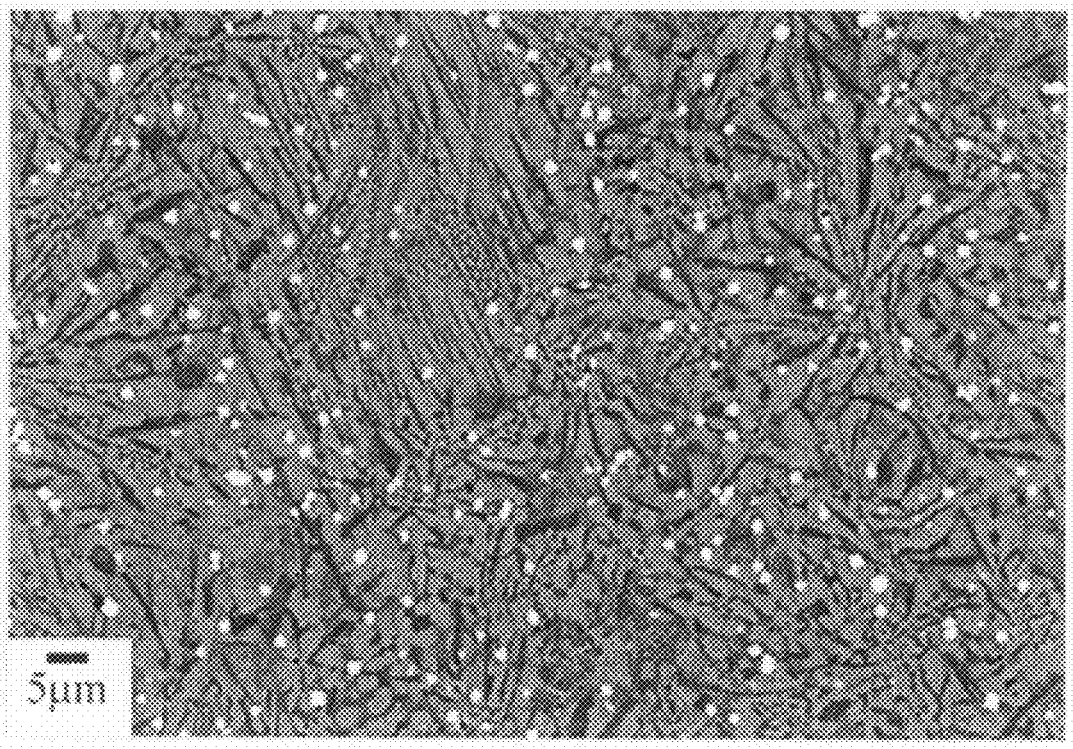
FIG. 2 illustrates a scanning electron image of the microstructure of Alloy LCW1 1/16 inch GMAW weld at the center of the single pass weld showing fine scale structure of the matrix.
Figure 3:
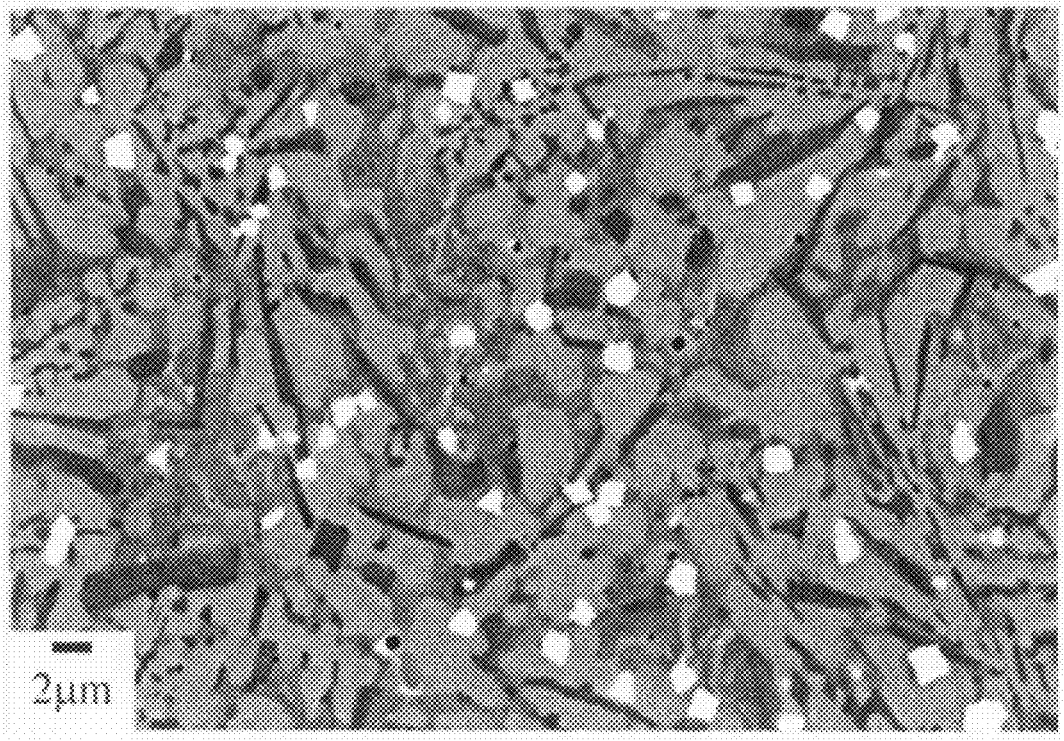
FIG. 3 illustrates a backscattered scanning electron image of Alloy LCW1 1/16 inch GMAW weld microstructure at the center of the single pass weld.
Figure 4:
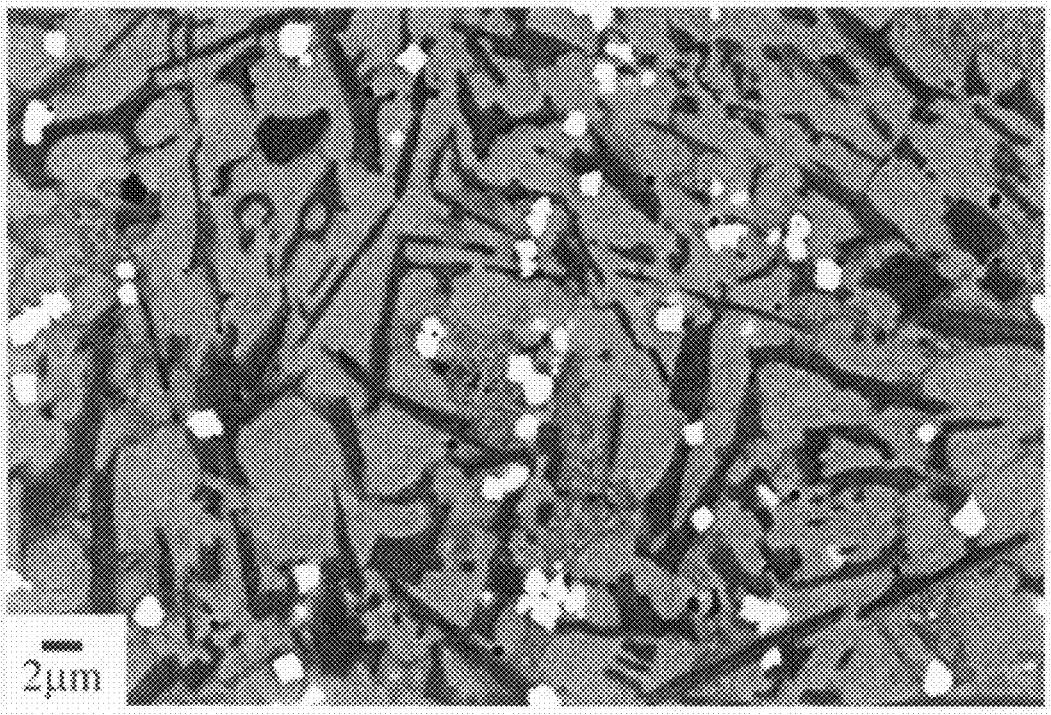
FIG. 4 illustrates a backscattered scanning electron image of Alloy LCW1 1/16 inch GMAW weld microstructure near the top of the single pass weld.

The present invention relates to the addition of niobium to iron based glass forming alloys. The present alloys include an alloy design approach that may be utilized to modify and improve existing iron based glass alloys and their resulting properties and may be related to three distinct properties. First, the alloys contemplated herein may increase the hardness of iron based alloys. Second, the alloys disclosed herein may increase the wear resistance of the iron based alloys. Third, the niobium addition may allow for increased refinement of the phases exhibited by the alloys disclosed herein. These effects may not only occur in the alloy design stage but may also occur in industrial gas atomization processing of feedstock and in PTAW welding of hardfacing weld overlays.

Furthermore, the improvements may generally be applicable to a range of industrial processing methods including PTAW, welding, spray forming, MIG (GMAW) welding, laser welding, sand and investment casting and metallic sheet forming by various continuous casting techniques.

A consideration in developing nanocrystalline or even amorphous welds, is the development of alloys with low critical cooling rates for metallic glass formation in a range where the average cooling rate occurs during solidification. This may allow high undercooling to occur during solidification, which may result either in the prevention of nucleation resulting in glass formation or in nucleation being prevented so that it occurs at low temperatures where the driving force of crystallization is very high and the diffusivities are minimal. Undercooling during solidification may also result in very high nucleation frequencies with limited time for growth resulting in the achievement of nanocrystalline scaled microstructures in one step during solidification.

In developing advanced welds with reduced microstructural scales, the nanocrystalline or near nanocrystalline/submicron grain size may be maintained in the as-welded condition by preventing or minimizing grain growth. Also, the as-crystallization grain size may be reduced by slowing down the crystallization growth front which can be achieved by alloying with elements which have high solubility in the liquid/glass but limited solubility in the solid. Thus, during crystallization, the supersaturated state of the alloying elements may result in an ejection of solute in front of the growing crystallization front which may result in a dramatic refinement of the as-crystallized/as solidified phase size. This may be accomplished in multiple stages to slow down growth throughout the solidification regime.

Consistent with the present invention, the nanocrystalline materials may include iron based glass forming alloys. It will be appreciated that the present invention may suitably employ other alloys based on iron, or other metals, that may be susceptible to forming metallic glass materials. Accordingly, an exemplary alloy may include a steel composition, comprising at least 40 at % iron and at least one element selected from the group consisting of Ti, Zr, Hf, V, Nb, Ta, Cr, Mo, W, Al, Mn, or Ni; and at least one element selected from the group consisting of B, C, N, O, P, Si and S. In a further embodiment, the alloys contemplated herein may include iron present at least 55 atomic % (at %), at least one transition metal present in the range of about 7 at % to 20 at %, at least one nonmetal/metalloids present in the range of about 0.01 at % to 25 at % and Niobium present in the range of about 0.01 at % to 10 at %, including all values and increments therein.

In a further embodiment, an exemplary alloy may include iron present at an atomic percent of greater than 55 at %, including in the range of about 55 at % to 65 at %. The alloy may also include Cr present in the range of about 7 at % to 16 at % and/or Mn present in the range of about 0.1 to 4%. The alloy may further include B present in the range of about 10 at % to 23 at %, C present in the range of about 0.1 at % to 9 at %, and/or Si present in the range of about 0.1 at % to 3 at %. Niobium may be added to the iron based alloy between 0.5-8 at % relative to the alloys and all incremental values in between, i.e. 0.5-2 at %, 2-5 at % 5-8 at % etc. More preferably, the niobium present in the alloy is 0.01-6 at % relative to the alloys. All ranges noted above may include all increments and values therein.

The alloys may be atomized by centrifugal, gas or water atomization producing powders of various sizes in the range of greater than 30 μm to less than 200 μm, including all values and increment therein. For example, powders may be available in the size range of +53 to −106 μm, +50 to −150 μm and +45 to −180 μm for use in various industrial application processes. Such powders may be used to provide hard coatings or surfaces via hardfacing technologies such as laser welding or plasma transferred arc welding.

In addition, the alloys may be provided in the form of cored wires or stick electrodes of various diameters including those in the range of 0.01 to 0.5 inches, including all increments and values therein. Such cored wires may be utilized in providing hard coatings or surfaces via hardfacing techniques including gas metal arc welding, metal inert gas welding, submerged arc welding, open arc welding, shielded metal arc welding or stick welding. Accordingly, it may be appreciated from the above that the alloys may be applied as a weld overlay via a number of processes.

The alloys may also be provided as a melt. The alloy melt may be cast into sheet or plate by various processes including single belt, twin belt, twin roll, continuous casting and other known processes. Furthermore, the alloys may be cast into ingots.

The formed alloys may exhibit a number of phases. For example, the formed alloys may include a matrix comprising iron rich phases ranging from approximately 0.1 to 5 microns in size, including all values and increments therein. The iron rich phase may be present in the range of approximately 40 to 80% by volume, including all values and increments therein. In addition, the alloys may include a chrome rich borocarbide phase ranging from approximately 1 to 50 microns in size, including all values and increments therein and present in the range of about 10 to 50% by volume, including all values and increments therein. Furthermore, the alloys may include a niobium rich borocarbide phase ranging from approximately 0.01 to 5 microns in size, including all values and increments therein and present in the range of about 1 to 10% by volume, including all values and increments therein. In addition, other complex carbide or borocarbide phases may be found in the alloys contemplated herein. It should be appreciated that the "rich" phases indicate that the iron, chrome or niobium are present at least about 30 at %.

The alloys described herein may exhibit a Vickers microhardness (HV300) in the range of about 800 to 1700 kg/mm$^2$, including all values and increments therein, such as 900 to 1550 kg/mm$^2$, etc. Such values may be obtained regardless of whether the alloy is cast as an ingot or a single or multiple pass overlay material. The alloys may also exhibit a Rockwell C hardness in the range of 64 to 77, including all values and increments therein. Furthermore, the alloys may exhibit a mass loss of less than 0.15 grams, such as in the range of 0.04 grams to 0.14 grams, including all values and increments therein as measured by ASTM G-65, procedure A, for first pass and second pass mass loss measurements, wherein the second pass was performed in the wear scar of the first pass. These values may also be obtained regardless of whether the alloy is cast as a plate or a single or multiple pass overlay.

In addition, where the alloys are applied as weld overlays it may be appreciated that the effects of dilution may be limited in such a manner that that full hardness of the alloys contemplated herein are attained within 250 microns from the substrate surface. Such substrates may include, for example, steel, aluminum or titanium alloys, as well as other base alloys.

EXAMPLES

The Examples herein are for purposes of illustration and are not meant to limit the disclosure herein or claims appended hereto.

Five alloys having the compositions illustrated in Table 1, below, were cast into small ingots.

TABLE 1

Alloy Compositions (atomic %)

| Alloy | Fe | Cr | B | C | Si | Mn | Nb |
|---|---|---|---|---|---|---|---|
| LCW0 | 62.5 | 12.9 | 18.1 | 4.5 | 0.7 | 0.1 | 1.2 |
| LCW1 | 61.7 | 12.9 | 18.1 | 4.9 | 0.7 | 0.1 | 1.6 |
| LCW2 | 60.7 | 12.9 | 18.2 | 5.0 | 0.7 | 0.1 | 2.4 |
| LCW3 | 59.6 | 13.0 | 18.3 | 5.0 | 0.8 | 0.1 | 3.2 |
| LCW4 | 58.7 | 13.0 | 18.3 | 5.0 | 1.0 | 0.1 | 3.9 |

The ingots were metallurgically mounted and polished. Vickers harness indentations were made on the cross section of the ingots at a 300 g load. Ten hardness indentations were taken at random locations on each ingot and the results are presented in Table 2, below. As shown, the average hardness of the all the ingots were found to be over 1,000 kg/mm$^2$ Vickers hardness (VH).

TABLE 2

Vickers Microhardness (HV300) (kg/mm$^2$) for LCW1 Cast Ingots

| Sample Number | LCW0 | LCW1 | LCW2 | LCW3 | LCW4 |
|---|---|---|---|---|---|
| Indentation 1 | 1233 | 1384 | 995 | 1105 | 1229 |
| Indentation 2 | 1200 | 1208 | 1031 | 1112 | 1206 |
| Indentation 3 | 1125 | 1080 | 1210 | 1228 | 1193 |
| Indentation 4 | 932 | 1512 | 1403 | 1046 | 1279 |
| Indentation 5 | 960 | 1114 | 1039 | 1120 | 1138 |
| Indentation 6 | 1292 | 1181 | 1175 | 1283 | 1128 |
| Indentation 7 | 1040 | 1285 | 1049 | 1025 | 1314 |
| Indentation 8 | 1045 | 1296 | 1090 | 1028 | 1281 |
| Indentation 9 | 970 | 1089 | 1176 | 1067 | 1188 |
| Indentation 10 | 1197 | 1287 | 1199 | 1078 | 1252 |
| Average Hardness | 1099 | 1244 | 1137 | 1109 | 1221 |

Alloy LCW1 was made into a 1.6 mm diameter cored wire. The wire was welding using a standard GMAW set up, which utilized a Miller Delta-Fab™ system. As shown in Table 3, five different welding parameters (A, B, C, D, E) were used to produce both single pass (1P) and double pass (2P) weld overlay samples. Note that welding were performed using both GMAW (gas shielded) and open-arc (no cover gas) conditions onto a 1 inch by 4 inch by 0.5 inch thick A36 base plate. The LCW1 appeared to exhibit minimal splatter and the absence of porosity, even after grinding.

TABLE 3

Parameters for LCW1 Weld Overlay Samples

| Sample | Substrate Size (inches) | Volts | ipm | Amps | Gas |
|---|---|---|---|---|---|
| LCW1-1PA | 1 × 4 | 26 | 225 | 205 | None/Open Arc |
| LCW1-2PA | 1 × 4 | 26 | 225 | 205 | None/Open Arc |
| LCW1-1PB | 1 × 4 | 26 | 250 | 210 | None/Open Arc |

TABLE 3-continued

Parameters for LCW1 Weld Overlay Samples

| Sample | Substrate Size (inches) | Volts | ipm | Amps | Gas |
|---|---|---|---|---|---|
| LCW1-2PB | 1 × 4 | 26 | 250 | 210 | None/Open Arc |
| LCW1-1PC | 1 × 4 | 26 | 275 | 225 | None/Open Arc |
| LCW1-2PC | 1 × 4 | 26 | 275 | 225 | None/Open Arc |
| LCW1-1PD | 1 × 4 | 26 | 275 | 210 | 75% Ar- 25% $Co_2$ |
| LCW1-2PD | 1 × 4 | 26 | 275 | 210 | 75% Ar- 25% $Co_2$ |
| LCW1-1PE | 1 × 4 | 26 | 275 | 280 | 98% Ar- 2% $Co_2$ |
| LCW1-2PE | 1 × 4 | 26 | 275 | 280 | 98% Ar- 2% $Co_2$ |

The weld overlay samples were ground flat after welding. Ten hardness indentations were taken at random locations on the surface of the welds. The average hardness is shown in Table 4. As can be seen the hardness for the samples has a range of about 69 to 71 Rc.

Dry wheel sanding abrasion studies were performed according to Procedure A of ASTM G-65 on the surface of the ground samples in two passes of 6,000 cycles each. The results of these tests are provided in Table 4. As shown, the weld overlays exhibited a wear resistance with mass loss from 0.049 to 0.131 grams (corresponding volume loss from 6.73 to 19.9 mm$^3$).

TABLE 4

Hardness/Wear Results on LCW1 Weld Overlay Samples

| Sample Number | Hardness (Rc) | Mass Loss 1$^{st}$ Pass 6,000 | Mass Loss 2$^{nd}$ Pass 6,000 | Volume Loss 1$^{st}$ Pass 6,000 | Volume Loss 2$^{nd}$ Pass 6,000 |
|---|---|---|---|---|---|
| LCW1-1PA | 69.2 | 0.1310 | 0.1265 | 17.94 | 17.28 |
| LCW1-2PA | 70.0 | 0.0898 | 0.0810 | 12.28 | 11.08 |
| LCW1-1PB | 70.1 | 0.1058 | 0.0950 | 14.47 | 12.99 |
| LCW1-2PB | 70.6 | 0.0828 | 0.0787 | 11.33 | 10.76 |
| LCW1-1PC | 70.5 | 0.1161 | 0.1096 | 15.92 | 14.99 |
| LCW1-2PC | 69.5 | 0.0969 | 0.0945 | 13.27 | 12.94 |
| LCW1-1PD | 70.2 | 0.1154 | 0.1086 | 15.80 | 14.84 |
| LCW1-2PD | 70.7 | 0.0623 | 0.0513 | 8.52 | 7.02 |
| LCW1-1PE | 70.5 | 0.0922 | 0.0856 | 12.61 | 11.71 |
| LCW1-2PE | 70.9 | 0.0598 | 0.0492 | 8.18 | 6.73 |
| LCW1-2PE | 70.9 | 0.0906 | 0.0841 | 12.43 | 11.54 |

Scanning electron microscope (SEM) studies were performed on LCW1 GMAW samples welded under parameter D of Table 3. Representative sample SEM pictures, taken with backscattered electron micrographs are given in FIGS. 1 through 4. The SEM studies illustrate that the weld structure exhibits a relatively refined uniform microstructure throughout the cross-section. The matrix phase consisting of iron rich ductile phases, having a gray color in the SEM micrographs, were from about 1 to 2 microns in size. The chrome rich borocarbide phases, having a black color in the micrographs, were from about 5 to 25 microns in size. The niobium rich borocarbide phases exhibiting a cubic/hexagonal structure, having a white color in the micrographs, were found to range from about 0.5 to 1.0 microns in size. The iron rich phase was estimated to be approximately 60 to 65% of the alloy by volume, the chrome rich phase was estimated to be approximately 30 to 35% of the alloy by volume and the white phase was estimated to be approximately 4 to 5% of the alloy by volume.

The weld overlay samples described above, were then tested using drop impact testing from a drop tower impacting onto a 0.75 inch toll steel anvil punch. Random samples were tested by hitting on the same spot for five impacts at 160 ft-lbs. No cracking or spallation was observed on the impacted welds, which may verify that the weld overlay sample alloys are relatively tough.

Figures 5A, 5B, 5C:
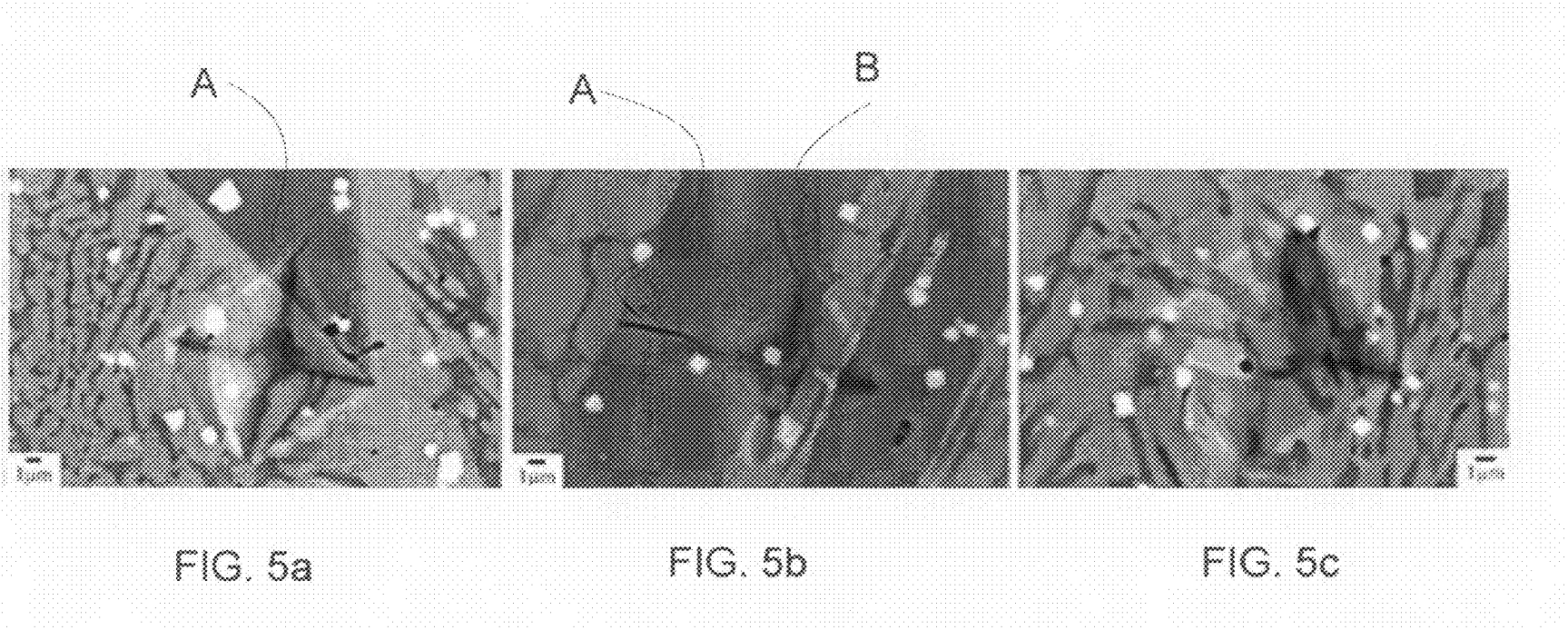
FIGS. 5*a, b* and *c* illustrate backscattered scanning electron images of hardness indentations into the microstructure of Alloy LCW1 1/16 GMAW weld showing that cracks be formed at the tip of the indentations either don't form or are blunted and stopped by the ductile phase matrix.

Vickers hardness indentations were made in the cross-section of a metallographically mounted and polished section of the sample welds. In a few cases, cracks were found to originate from the corners of the hardness indentions when the hardness indention hit a hard (black) borocarbide phase. See FIG. 5. The cracks propagated a few microns and/or until hitting the grey ductile phases of the matrix and the was immediately stopped. FIG. 5*a* illustrates crack "A" which is shown to propagate about 1 micron through the alloy and in particular in the chrome rich borocarbide phase. FIG. 5*b* illustrates crack "A," which is shown to propagate through the chrome rich borocarbide phase and end at the iron rich phase. Crack "B" is shown to propagate a few microns into the chrome rich borocarbide phase and terminate.

A wire of Alloy LCW 1 welded via GMAW onto an A36 steel substrate using the process parameter D of Table 3. The welded sample was cut to reveal the cross-section and was metallographically mounted and polished. A Vickers microhardness traverse at a 100 g load was done with approximately 0.005 inch spacing starting in the base metal A36 and then up through the weld to the top of the sample. The results of the microhardness testing are shown in Table 5. It is noted that hardness points 1 through 3, were performed in the base substrate, the A36 steel, and that the remaining hardness points 4 to 25 were performed in the weld overlay alloy.

TABLE 5

Vickers Microhardness (HV100) Across Weld Overlay Sample

| Hardness Point No. (0.005 inch spacing) | Hardness ($kg/mm^2$) |
|---|---|
| 1 | 165 |
| 2 | 165 |
| 3 | 178 |
| 4 | 1103 |
| 5 | 1194 |
| 6 | 1090 |
| 7 | 1140 |
| 8 | 1196 |
| 9 | 1280 |
| 10 | 1060 |
| 11 | 1136 |
| 12 | 1022 |
| 13 | 1059 |
| 14 | 1094 |
| 15 | 1274 |
| 16 | 1066 |
| 17 | 1086 |
| 18 | 1037 |
| 19 | 1291 |
| 20 | 1099 |
| 21 | 1094 |
| 22 | 1080 |
| 23 | 1034 |
| 24 | 1269 |
| 25 | 1105 |

Figure 6:
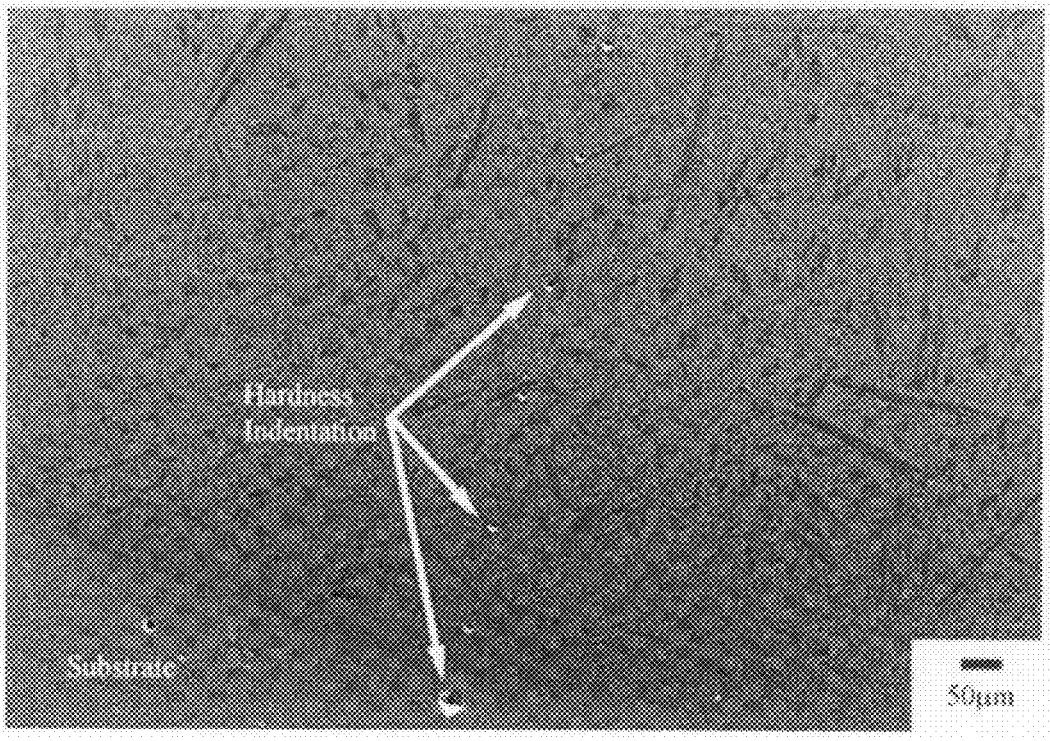
FIG. 6 illustrates a scanning electron image of hardness indentations across the Alloy LCW1 1/16 GMAW weld single pass weld interface. Point 3 of Table 5 is at the bottom of the figure within the substrate.
Figure 7A:
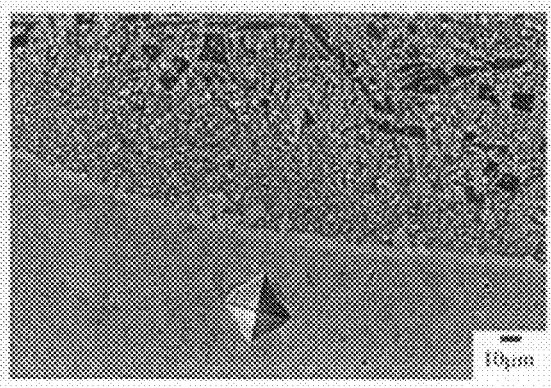
FIGS. 7*a* and *b* illustrate scanning electron images of hardness indentions at point 3 (within the substrate) and point 4 (within the weld overlay) as described in Table 5 across the interface of A36 steel substrate and LCW1 1/16 GMAW weld single pass weld.
Figure 7B:
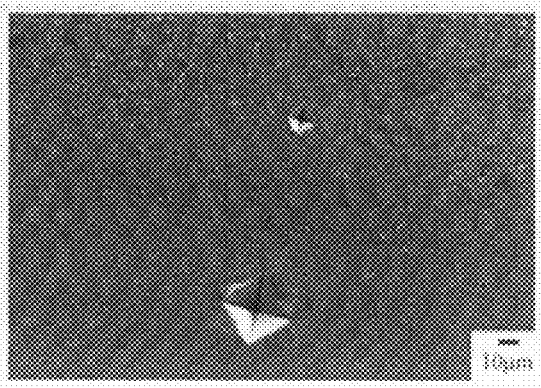
Figure 8:
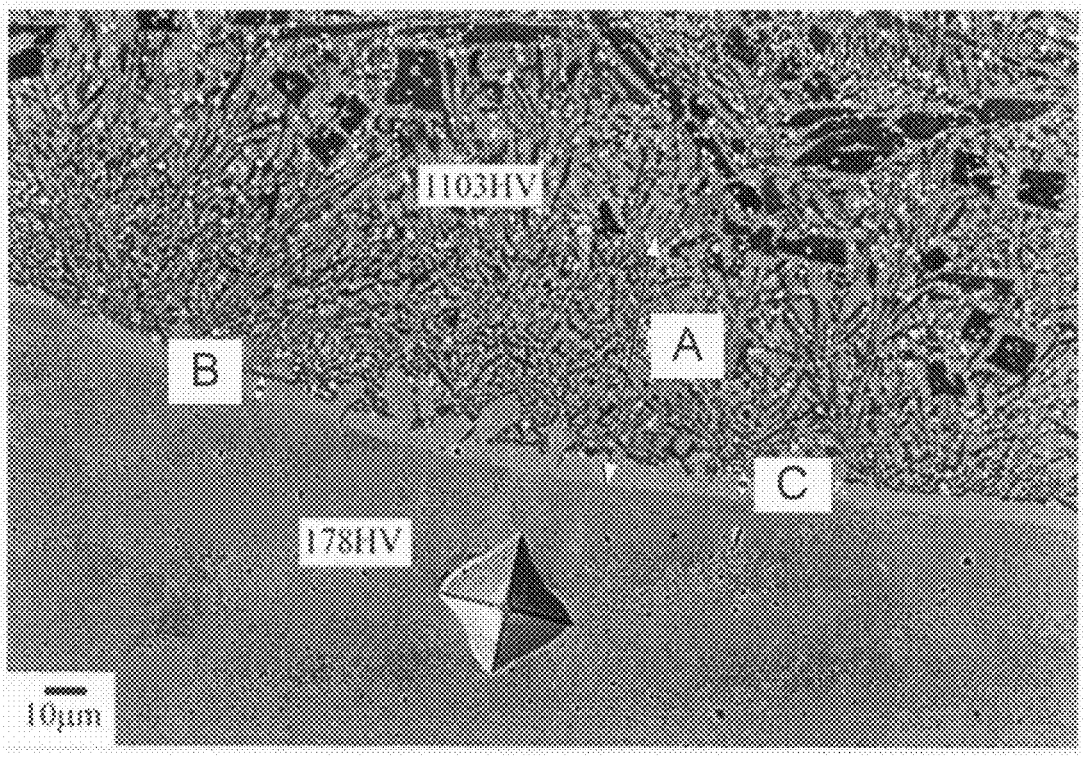
FIG. 8 illustrates a backscattered scanning electron image of Vickers hardness indentations in the A36 steel substrate and the LCW1 1/16 GMAW weld single pass weld along with the distance from the boundary layer.
Figure 9:
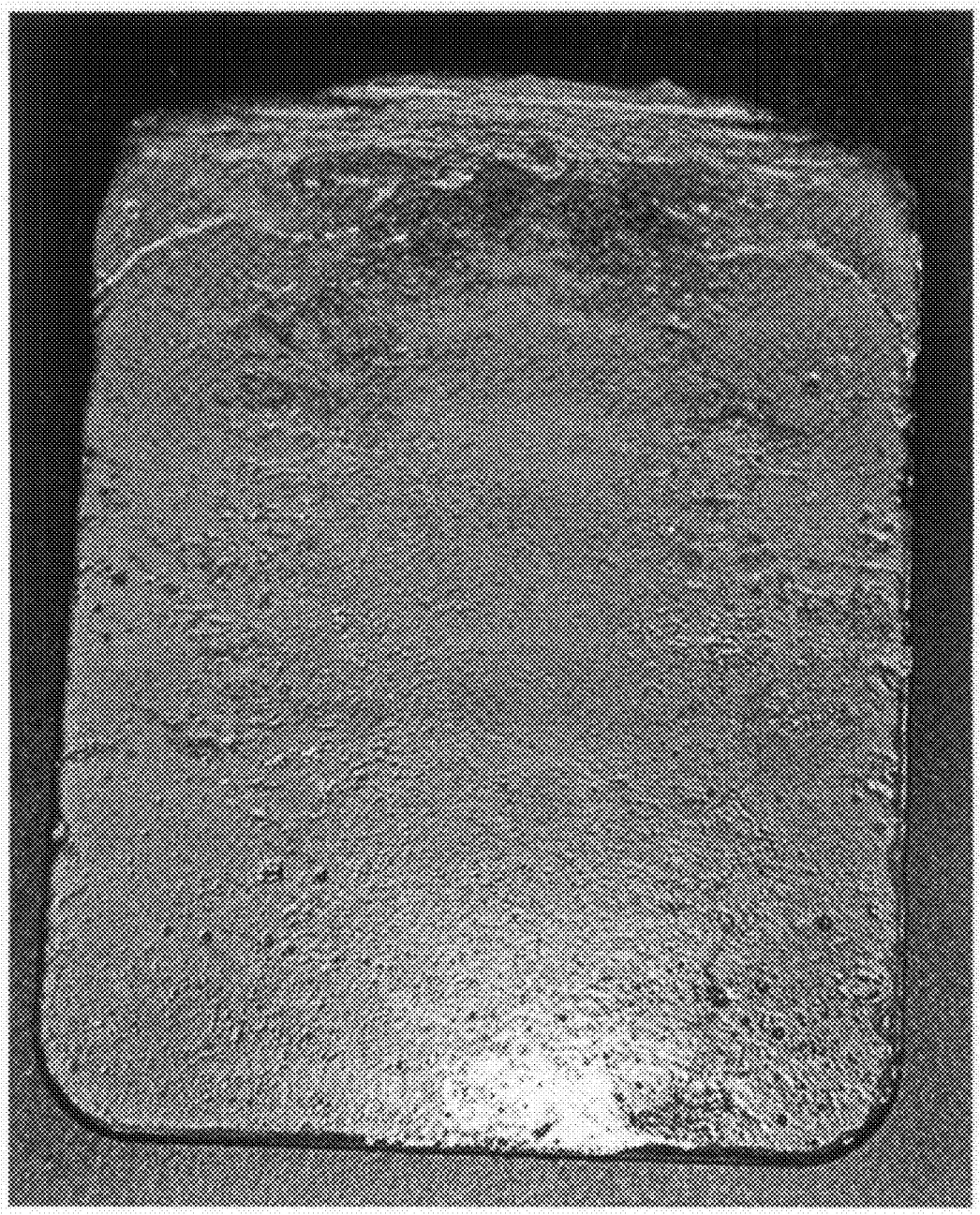
FIG. 9 illustrates an optical picture of the as cast LCW1 plate.

FIG. 6 is an SEM micrograph of the substrate and weld overlay illustrating the Vickers Microhardness measurements at points 3 through 9. FIGS. 7*a* and *b* illustrate the Vickers Microhardness measurements at points 3 and 4. FIG. 7*a* is a backscattered scanning electron microscope image, whereas FIG. 7*b* is a secondary electron micrograph image. FIG. 9 is backscattered scanning electron microscope image illustrating the distance between the substrate and hardness point 4, which is illustrated to be 57.9 μm at measurement "A." The boundary layer between the substrate and the weld overlay appears to be less than 10 μm at measurements "B" and "C" respectively.

In addition, the LCW 1 allow was die cast into a plate having the dimensions of 4 inches by 5 inches by 0.5 inches using a copper die. The LCW1 plate was found to be crack free and is illustrated FIG. 9. The sides of the plate were ground to yield a plate that was 10 mm in thickness. Hardness indentations were taken across the cross-section of the plate in both horizontal and vertical directions. The 19 hardness indentations are shown in Table 6 and indicate that the cast plate exhibits a hardness in the range of about 69.7 Rc to about 70.8 Rc. From the cast plate, a 1 inch by 4 inch sample was cut out and then the surface was ground. To measure the abrasion resistance, ASTM G-65 dry wheel sand abrasion studies were done according to Procedure A and the results are given in Table 7. As shown in the table, the mass loss was found to be about 0.116 to 0.122 grams.

TABLE 6

Hardness Results LCW1 Plate

| Hardness Point | Hardness (Rc) |
|---|---|
| 1 | 70.3 |
| 2 | 70.2 |
| 3 | 70.1 |
| 4 | 69.8 |
| 5 | 69.5 |
| 6 | 70.1 |
| 7 | 70.0 |
| 8 | 69.9 |
| 9 | 70.2 |
| 10 | 70.3 |
| 11 | 70.4 |
| 12 | 70.8 |
| 13 | 70.4 |
| 14 | 70.8 |
| 15 | 70.2 |
| 16 | 69.9 |
| 17 | 70.0 |
| 18 | 70.1 |
| 19 | 69.7 |

TABLE 7

Wear Results on LCW1 Plate

| Test Number | Mass Loss (g) $1^{st}$ 6,000 cycles | Volume Loss ($mm^3$) $1^{st}$ 6,000 cycles |
|---|---|---|
| 1 | 0.116 | 15.87 |
| 2 | 0.122 | 16.69 |

The foregoing description has been presented for purposes of illustration. It is not intended to be exhaustive or to limit the invention to the precise steps and/or forms disclosed, and obviously many modifications and variations are possible in light of the above teaching.

What is claimed is:

1. An iron based alloy weld overlay applied on a substrate comprising:

an iron based alloy including 55% to 65 at % Fe, 7 at % to 16% Cr, 0.5 at % to 8 at % Nb, 13 at % to 22 at % B and 2 at % to 7 at % C;

wherein said alloy is a nanocrystalline weld overlay material and exhibits a hardness when applied to said substrate and cooled at a rate sufficient to provide greater than or equal to Rc 64 and a Vickers Hardness in the range of 800 $kg/mm^2$ to 1700 $kg/mm^2$, wherein the iron based alloy comprises a Fe rich phase containing at least 30 atomic percent iron wherein said Fe rich phase is present in the range of about 40 to 80% by volume and range from 2.0 to 5.0 microns in size, chrome rich borocarbide phases containing at least 30 atomic percent chromium wherein said chrome rich phase is present in the range of about 10 to 50% by volume and range from 1 to 50 microns in size, and niobium rich borocarbide phases containing at least 30 atomic percent niobium wherein said niobium rich phase is present in the range of about 1 to 10% by volume and said niobium rich phase is 0.01 to 5 microns in size and said hardness is attained within 250 microns from the substrate surface and wherein said alloy exhibits a mass loss of less than 0.15 grams as measured by ASTM G-65 Procedure A.

2. The iron based alloy weld overlay of claim 1, wherein Mn is present in the range of about 0.1 at % to 4 at %.

3. The iron based alloy weld overlay of claim 1, wherein Si is present in the range of about 0.1 at % to 3 at %.

* * * * *